US005195899A

United States Patent [19]

Yatsu et al.

[11] Patent Number: 5,195,899

[45] Date of Patent: Mar. 23, 1993

[54] IMPEDANCE MATCHED ELECTRICAL CONNECTOR

[75] Inventors: Nobuo Yatsu; Hideo Miyazawa; Kouji Watanabe, all of Kawasaki, Japan

[73] Assignee: Fujitsu Limited, Kawasaki, Japan

[21] Appl. No.: 882,005

[22] Filed: May 13, 1992

[30] Foreign Application Priority Data

May 13, 1991 [JP] Japan ..... 3-107437

[51] Int. Cl.[5] ..... H01R 13/648; H01R 13/652

[52] U.S. Cl. ..... 439/101; 439/108; 439/607

[58] Field of Search ..... 439/101, 108, 607-610

[56] References Cited

U.S. PATENT DOCUMENTS

| | | | |
|---|---|---|---|
| 4,762,500 | 8/1988 | Dola et al. | 439/79 |
| 4,806,110 | 2/1989 | Lindeman | 439/108 |
| 4,950,172 | 8/1990 | Anhalt et al. | 439/108 |
| 5,035,632 | 7/1991 | Rudoy et al. | 439/607 |
| 5,057,028 | 10/1991 | Lemke et al. | 439/101 |
| 5,104,329 | 4/1992 | Brown et al. | 439/108 |
| 5,116,230 | 5/1992 | Dechelette et al. | 439/101 |
| 5,137,472 | 8/1992 | Hillbish et al. | 439/108 |

FOREIGN PATENT DOCUMENTS 49-6543 2/1974 Japan .

*Primary Examiner*—Gary F. Paumen
*Attorney, Agent, or Firm*—Staas & Halsey

[57] ABSTRACT

An impedance matched electrical connector comprising a plug connector member and a matable jack connector member for an electric connection between printed wiring boards. The plug connector member comprises a plug housing of insulating material in which planar and elongated male conductors, a first row of male signal terminals, and a second row of male signal terminals are arranged in respective, parallel planes. A conductive ground shell is attached to the outer peripheral surface of the plug housing, so that the first and second rows of male signal terminals are arranged between the elongated male conductors and a planar portion of the ground shell, respectively, to thereby form a strip line structure by which the impedance of the connector is matched to the impedance of the printed wiring boards and the amount of crosstalk is relatively low.

14 Claims, 7 Drawing Sheets

IMPEDANCE MATCHED ELECTRICAL CONNECTOR

BACKGROUND OF THE INVENTION

1. Field of the Invention

The present invention relates to an impedance matched electrical connector comprising a plug connector member and a jack connector member matable with the plug connector member for providing an electric connection between impedance matched printed wiring boards.

2. Description of the Related Art

With the development of high speed signal processing in computers, it has been required that multielectrode connectors for computers should have a characteristic impedance matched with a characteristic impedance of printed wiring boards and cables to avoid a reflection of signals in the connectors, and that the connectors should provide for a low level of crosstalk between the signals. To meet such requirements for high speed signal processing, it is necessary that the printed wiring boards, wirings of the cables, and terminals in the electrical connectors are not mere electrical connector means, but are also transmission lines. Namely, it is desirable to arrange the signal lines relative to the ground conductor in a constant disposition (or a cross-sectional shape) in order not to disturb electromagnetic waves around the signal lines.

There are mainly two kinds of signal transmissions: (a) an unbalanced transmission that uses a signal conductor and a ground conductor, and (b) a balanced transmission that uses a positive signal conductor and a negative signal conductor. Unbalanced transmission is frequently used in printed circuit boards and electrical casings for digital signal transmissions. The unbalanced transmission is classified into the following three types depending on the disposition of the signal conductor and the ground conductor, i.e., a coaxial structure in which a core signal conductor is surrounded by a cylindrical ground conductor with a dielectric material (insulating material) filled therebetween; a strip line structure in which a signal conductor is sandwiched between a pair of ground planes with a dielectric material filled therebetween, and a microstrip line structure in which a signal conductor is arranged parallel to only one (i.e., a single) ground plane with a dielectric material filled therebetween.

Transmission characteristics vary between the strip line structure and the microstrip line structure. In the strip line structure, the occurrence of noise and crosstalk are relatively low. Signals are less affected by external electromagnetic fields, and the impedance characteristic is stable. In the microstrip line structure, signals are relatively affected by external electromagnetic fields (i.e., the shielding effect is small). The occurrence of noise is high, and the impedance characteristics are unstable. Also, the signals are affected by the electromagnetic fields emitted from the signal conductors themselves, depending on the disposition of the dielectric material and the conductors; further, the occurrence of crosstalk is relatively high.

The respective impedance characteristics, as between the strip line structure and the microstrip line structure, are different, even when the dimensional conditions of the corresponding elements are identical. It is well known that the impedance $Z_0$ can be calculated by the following relationships, in which e is a dielectric constant of dielectric material; d is a diameter of a signal conductor when it has a circular cross section; and h is a distance between the center of the signal conductor and the ground plane.

The impedance $Z_0$ of the strip line structure $$Z_0 = \frac{138}{\sqrt{\epsilon}} \log\left(\frac{8h}{\pi d}\right)$$

The impedance $Z_0$ of the microstrip line structure is:

$$Z_0 = \frac{138}{\sqrt{\epsilon}} \log\left(\frac{4h}{d}\right)$$

The printed wiring boards are formed in a multi-layered structure having outer conductor layers and an innermost conductor layer with dielectric layers therebetween. The ground conductor and the power supply conductor are usually located on the innermost conductor layer and thus together constitute a microstrip line structure, in which the ground plane is arranged only on one side of the signal conductors.

There are proposals for electrical connectors having an impedance characteristic matching the impedance of the printed wiring boards to which the electrical connector is attached. For example, Japanese Examined Utility Model (Kokoku) 49-6543 discloses an electrical connector for printed wiring boards having a microstrip structure. This electrical connector is shown in FIGS. 8A to 8C of the attached drawings, and comprises a plug connector member 50 and a jack connector member 52 which is matable with the plug connector member 50. FIG. 8B is a perspective, cross-sectional view through the jack connector member 52 and FIG. 8C is a perspective cross-sectional view through the plug connector member 50. The plug connector member 50 comprises a plug housing 54 of insulating material with three rows of holes, in which a first row of male signal terminals 56, a second row of male signal terminals 58 and a generally planar and elongated male conductor 60 are fitted, respectively The elongated male conductor 60 is arranged between the male signal terminals 56 and 58 so that a microstrip line structure is formed. The jack connector member 52 comprises a jack housing 62 of insulating material with three rows of apertures 64, 66 and 68, 64 and 66 comprising plural holes and 69 comprising at least one elongated slot. A generally planar and elongated female conductor 70 is inserted in the central slot 68 to receive the elongated male conductor 60 for mating engagement therewith. Upper and lower female terminals 72 and 74 are inserted in the upper and lower holes 64 and 66, respectively, for mating engagement with the male signal terminals 56 and 58. The elongated female conductor 70 also forms a microstrip line structure with the female signal terminals 72 and 74. A shield case 76 is attached over the jack housing 62. This shield case 76 shields external electromagnetic waves and is not designed to control the impedance, i.e., as a strip line structure.

In this connector, the male conductor 60 has a longer length than that of the male signal terminals 56 and 58 so that the male conductor 60 first engages the central slot 68 of the jack housing 62 to function as a guide when the plug connector member 50 is mated with the jack connector member 52. Also, the male conductor 60 has a central slit 78 that cooperates with a guide wall 80 of the jack housing 62, at the discontinuity of the central slot 68, to function as a guide when the plug connector member 50 is mated with the jack connector member 52.

U.S. Pat. No. 4,762,500 also discloses an impedance matched electrical connector with a microstrip structure. This connector also includes a planar and elongated ground conductor and two rows of signal terminals on either side of the ground conductor to form a microstrip structure.

Recently, multi-layered printed wiring boards have been developed and the number of conductive layers of such printed wiring boards is increasing. Thus the ground conductor and the power supply conductor are not necessarily located on the innermost conductor layer and instead are distributed on several layers so that the signal conductors are arranged between the ground conductor and the power supply conductor or between the ground conductors. In this case, a strip line structure is constituted in which the ground planes are arranged on either side of the signal conductors, since the constant-voltage power supply is deemed to be an equivalent of the ground with regard to high frequency signal processing.

It is possible in principle to design an electrical connector having a microstrip line structure of a particular impedance matched to an impedance of a desired multilayered printed wiring board. To this end, it is necessary to select the distance h between the center of the signal conductor and the ground plane in relation to the diameter of the signal conductor. In fact, however, when the density of the signal conductors becomes large, the diameter of the signal conductor becomes small and the pitch between the adjacent signal conductors becomes small. There is a problem in the electrical connector having a microstrip line structure of a particular impedance selected under these conditions, in that that the impedance is relatively unstable and the occurrence of crosstalk is high.

SUMMARY OF THE INVENTION

The object of the present invention is to provide an impedance matched electrical connector in which the impedance is relatively stable and the occurrence of crosstalk is low.

According to the present invention, there is provided an impedance matched electrical connector comprising a plug connector member and a jack connector member matable with the plug connector member and affording an electric connection between printed wiring boards. The plug connector member comprises a plug housing of insulating material and the plug housing having an axis, an outer peripheral surface about the axis, at least one elongated hole arranged in a first plane parallel to the axis, a first row of small holes arranged in a second plane parallel to the first plane, and a second row of small holes arranged in a third plane parallel to the first plane on the side of at least one elongated hole (i.e., slot) remote from the first row of small holes; the outer peripheral surface including first and second opposite planar outer surface portions arranged parallel to the first plane in an overlapping relationship with at least one elongated hole and the first and second rows of small holes; at least one generally planar and elongated male conductor fitted in at least one elongated hole (i.e., slot); a first row of male signal terminals fitted in said first row of small holes, respectively; a second row of male signal terminals fitted in said second row of small holes, respectively, and a conductive ground shell attached to the outer peripheral surface of the plug housing; the ground shell having a first planar shell portion covering the first planar outer surface portion such that the distance between the first planar shell portion and the first row of male signal terminals substantially equals the distance between the first row of male signal terminals and the elongated male conductor, and a second planar shell portion covering the second planar outer surface portion such that the distance between the second planar shell portion and the second row of male signal terminals substantially equals a distance between the second row of male signal terminals and the elongated male conductor, whereby the impedance of the first and second rows of male signal terminals is controlled by the at least one elongated male conductor and the ground shell. The jack connector member comprises a jack housing of insulating material, at least one female conductor for mating engagement with the elongated male conductor, a first row of female signal terminals for mating engagement with the first row of male signal terminals, and a second row of female signal terminals for mating engagement with the second row of male signal terminals.

With this arrangement, a strip line structure is constituted by the conductive ground shell and the at least one female conductor, between which the first row of male signal terminals and the second row of male signal terminals are respectively arranged via an insulating material of the plug housing. Therefore, an electrical connector having a relatively stable impedance and low occurrence of crosstalk is realized.

Preferably, the at least one elongated male conductor comprises at least one male ground conductor and at least one male power supply conductor arranged in the first plane in a row, and the at least one female conductor comprises correspondingly at least one female ground conductor and at least one female power supply conductor arranged in a plane in a row.

Preferably, the ground shell is connected to at least one elongated male conductor for electrical connection therebetween, and preferably for mechanical connection of the ground shell to the plug housing.

Preferably, the ground shell is formed in a continuously closed shape encircling the outer peripheral surface of the plug housing.

The plug housing preferably has a first end directed to a printed wiring board, a second end directed to the jack connector member, and an outer peripheral shoulder adjacent to the first end; the ground shell being arranged on the outer peripheral surface of the plug housing in an abutment relationship with the outer peripheral shoulder. The ground shell has a length such that the ground shell abuts one end thereof against the outer peripheral shoulder of the plug housing and extends beyond the second end of the plug housing to the jack housing. The jack housing preferably has an outer peripheral surface, a first end directed to the plug housing, a second end directed to another printed wiring board, and an outer peripheral shoulder adjacent to the second end of the jack housing; the ground shell extending beyond the second end of the plug housing to the jack housing with the first end of the jack housing abutting the second end of the plug housing.

In this case, the ground shell covers at least partly the outer peripheral surface of the jack housing so that a portion of the ground shell overlaps at least one female conductor. The ground shell extends between the outer peripheral shoulder of the plug housing and the outer peripheral shoulder of the jack housing. The at least one elongated conductor of the plug connector member extends beyong the second end of the plug housing.

Preferably, the ground shell has a guide means and the jack housing has an associated guide means for assisting a mating engagement of the at least one male conductor with the at least one female conductor.

BRIEF DESCRIPTION OF THE DRAWINGS

The present invention will become more apparent from the following decription of the preferred embodiments, with reference to the accompanying drawings, in which.

DESCRIPTION OF THE PREFERRED EMBODIMENTS

Figure 1:
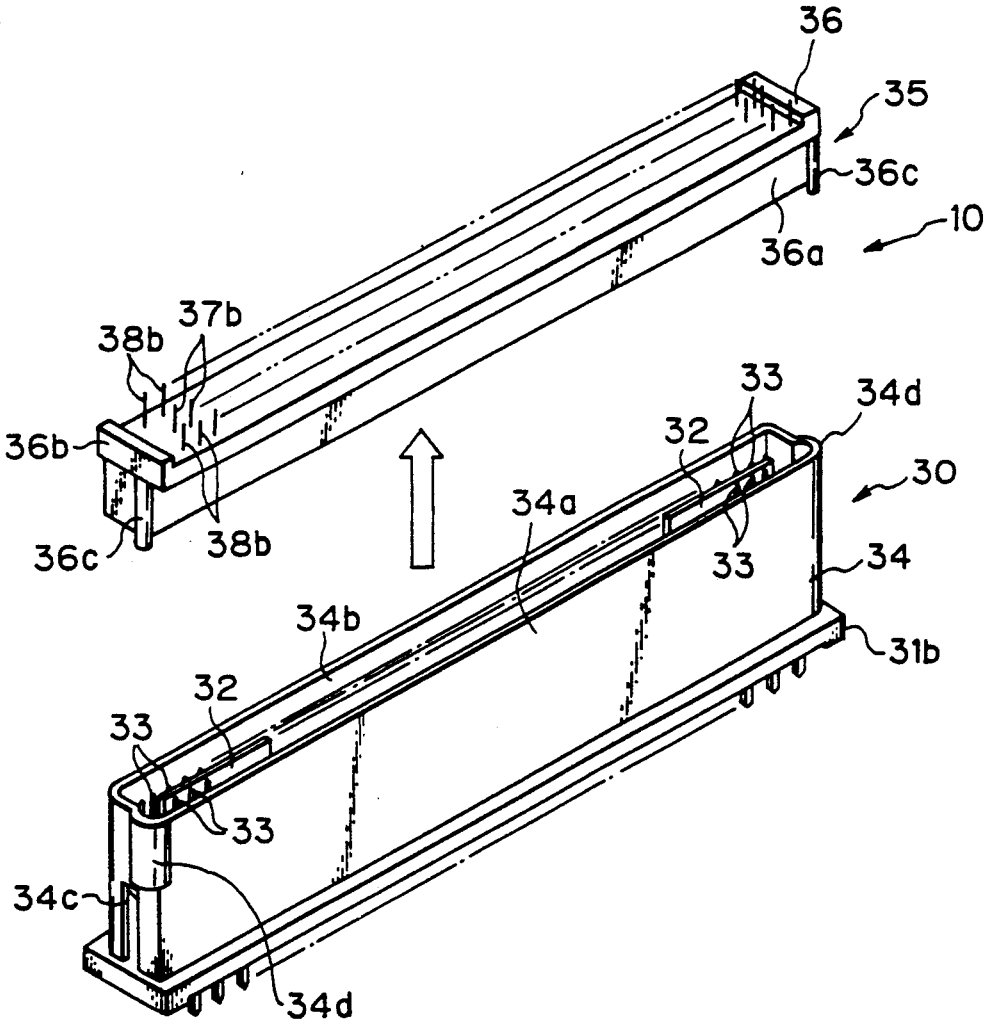
FIG. 1 is an exploded perspective view of an electrical connector according to the first embodiment of the present invention.
Figure 2:
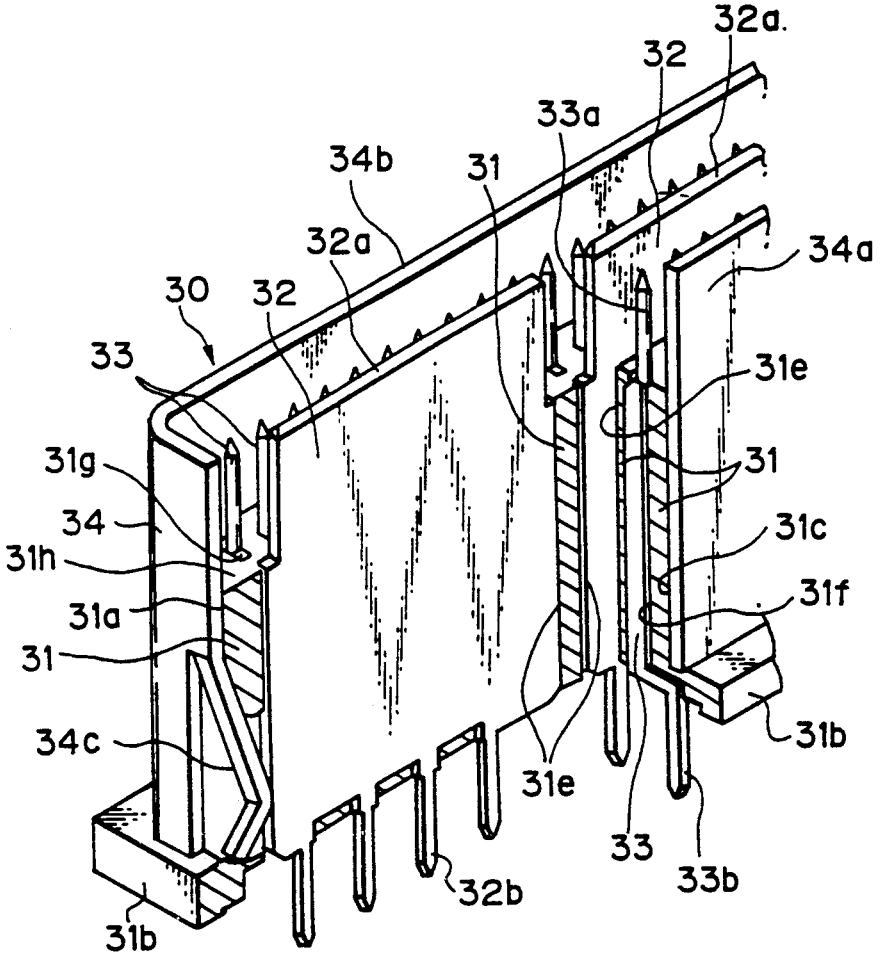
FIG. 2 is a partially enlarged cutaway view of the plug connector member of FIG. 1.
Figure 3:
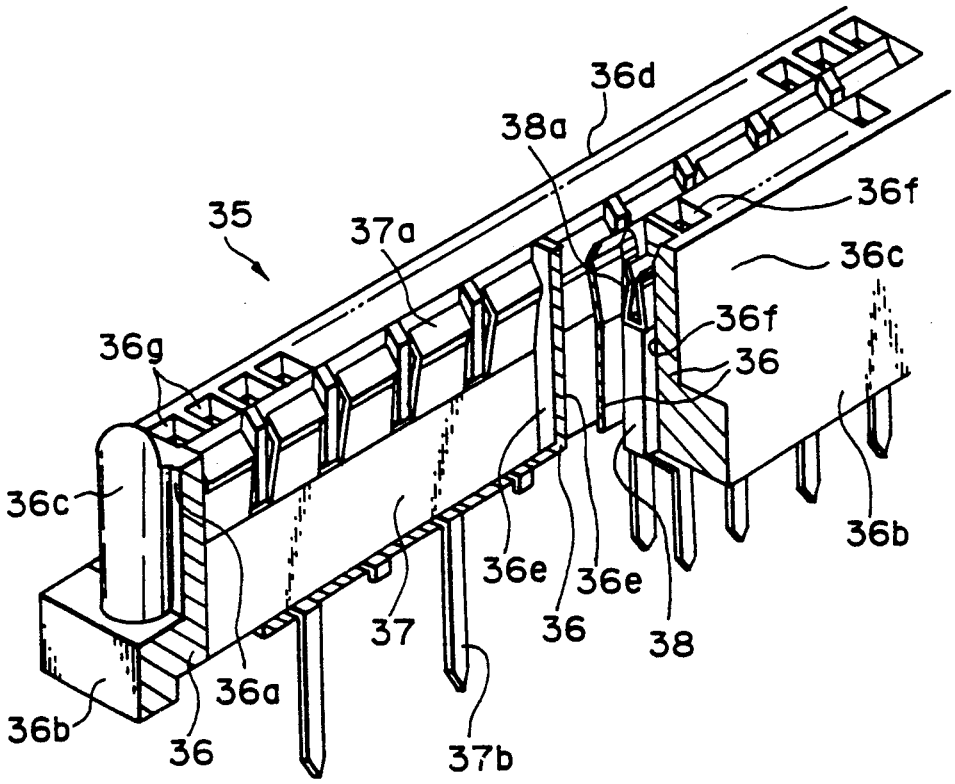
FIG. 3 is a partially enlarged cutaway view of the jack connector member of FIG. 1.
Figure 4:
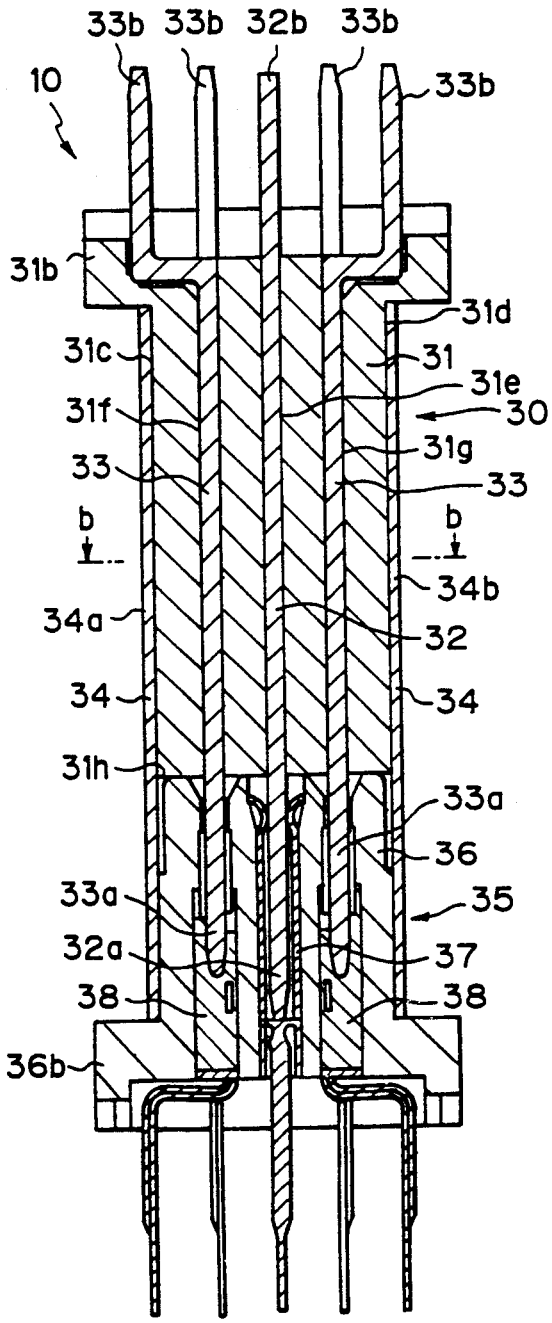
FIG. 4 is a cross-sectional view of the electrical connector of FIG. 1, with the plug connector member and the jack connector member coupled together and shown in a position inverted from FIG. 1.

FIGS. 1 and 4 show an electrical connector 10 according to the present invention comprising a plug connector member 30 and a jack connector member 35 matable with the plug connector member 30 for providing an electric connection between printed wiring boards (not shown). FIG. 2 is a partially enlarged cutaway view of the plug connector member 30 and FIG. 3 is a partially enlarged cutaway view of the jack connector member 35.

As shown in FIGS. 1, 2 and 4, the plug connector member 30 comprises a plug housing 31 of insulating material having an axis shown by the arrow in FIG. 1 along which the plug connector member 30 is mated with the jack connector member 35. The plug housing 31 has an outer peripheral surface 31*a* of a generally rectangular cross-sectional shape and an outer peripheral shoulder 31*b* adjacent to one end of the plug housing 31. The outer peripheral surface 31*a* includes first and second opposite planar outer surface portions 31*c* and 31*d* extending along the long sides of the rectangular cross-sectional shape. The plug housing 31 also has a plurality of elongated holes (i.e., slots) 31*e* arranged in a first plane parallel to the axis and to the outer surface portions 31*c* and 31*d*, a first row of small holes 31*f* arranged in a second plane parallel to the first plane, and a second row of small holes 31*g* arranged in a third plane parallel to the first plane on the side of the elongated holes 31*e* remote from the first row of small holes 31*g*. The first and second opposite planar outer surface portions 31*c* and 31*d*, the elongated holes (i.e., slots) 31*e*, and the first and second rows of small holes 31*f* and 31*g* all extend perpendicular to the sheet of FIG. 4, and thus are parallel to each other in an overlapping (i.e., opposed) relationship.

Planar and elongated male conductors 32 are fitted in the elongated holes 31*e*, respectively. The elongated male conductors 32 comprise at least one male ground conductor and at least one male power supply conductor arranged in the first plane in a row. As shown in FIGS. 1 and 2, each of the elongated male conductors 32 has a sharpened end or contact 32*a* for connection to a corresponding female conductor and branched ends or contacts 32*b* for connection to a printed wiring board (not shown). The branched lead ends 32*b* extend from the outer peripheral shoulder 31*b* of the plug housing 31.

A first row of male signal terminals 33 are fitted in the first row of small holes 31*f*, respectively, and a second row of male signal terminals 33 are fitted in the second row of small holes 31*g*, respectively. Each of the male signal terminals 33 has a sharpened end or contact 33*a* for connection to a corresponding female signal terminal and other end or contact 33*b* for connection to a printed wiring board. The ends 33*b* of the male signal terminals 33 extend from the outer peripheral shoulder 31*b* of the plug housing 31 and the projecting end portions are bent in a staggered array. The male conductors 32 are made from a rigid flat plate of a good electric conductivity and the male signal terminals 33 are made from small rods of good electric conductivity.

Figure 5:
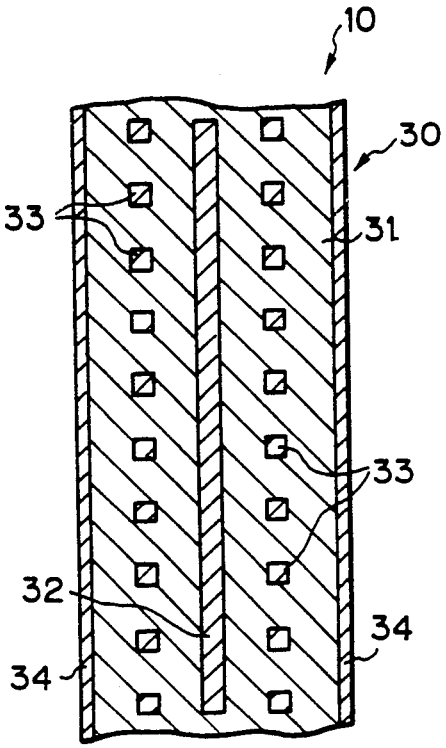
FIG. 5 is a cross-sectional view of the connector of FIG. 4 through the plug connector member.

A conductive ground shell 34 of good electric conductivity is attached to the outer peripheral surface 31*a* of the plug housing 31. The ground shell 34 is formed in a continuously closed shape, encircling the outer peripheral surface 31*a* of the plug housing 31, and has a generally rectangular cross-sectional shape to fit over the plug housing 31. The ground shell 34 thus has a first planar shell portion 34*a* covering the first planar outer surface portion 31*c* of the plug housing 31 and a second planar shell portion 34*b* covering the second planar outer surface portion 31*d* of the plug housing 31. As shown in FIG. 5, the ground shell 34 is intended to provide a strip line structure for the signal terminals 33. To this end, the first planar shell portion 34*a* is arranged such that the distance between the first planar shell portion 34*a* and the first row of male signal terminals 33 substantially equals the distance between the first row of male signal terminals 33 and the elongated male conductors 32, and the second planar shell portion 34*b* is arranged such that the distance between the second planar shell portion 34*b* and the second row of male signal terminals 33 substantially equals the distance between the second row of male signal terminals 33 and the elongated male conductor 32.

The ground shell 34 is arranged on the outer peripheral surface 31*a* of the plug housing 31 in an abutment relationship with the outer peripheral shoulder 31*b* and has a length such that the ground shell 34 abuts one end thereof against the outer peripheral shoulder 31*b* of the plug housing 31 and extends beyond the end 31*h* of the plug housing 31.

The ground shell 34 has a tongue 34*c* at a small (i.e., the shorter or smaller) side of the ground shell 34; the tongue 34*c* is bent inwardly so that the tongue 34*c* is connected to the elongated male conductor 32 through a hole of (i.e., an opening in) the plug housing 31. The tongue 34*c* engages the wall of the plug housing 31 and also serves to mechanically connect the ground shell 34 to the plug housing 31.

The ground shell 34 also has a pair of outwardly bulging arcuate guide walls 34*d* at opposite corners of the ground shell 34 along one side of the rectangular shape for assisting a mating engagement of the male conductors 32 with corresponding female conductors in the jack connector member 35.

As shown in FIGS. 1, 3 and 4, the jack connector member 35 comprises a jack housing 36 of insulating material, elongated female conductors 37 for mating engagement with the elongated male conductor 32, a first row of female signal terminals 38 for mating engagement with the first row of male signal terminals 33, and a second row of female signal terminals 38 for mating engagement with the second row of male signal terminals 33.

The jack housing 36 has an outer peripheral surface 36*a* of a generally rectangular cross-sectional shape in conformity with the outer peripheral surface 31*a* of the plug housing 31, so that the plug housing 31 abuts the jack housing 36 in an end to end relationship when coupled together, as shown in FIG. 4. The jack housing 36 has an outer peripheral shoulder 36*b* adjacent to one end of the plug housing 31 that is remote from the plug housing 31 when coupled together. The outer peripheral surface 36*a* includes first and second opposite planar outer surface portions 36*c* and 36*d*, and the jack housing 36 has a plurality of elongated holes 36*e* for inserting the elongated female conductors 37, and first and second rows of small holes 36*f* and 36*g* for inserting therein (and which thereby receive) the female signal terminals 38.

Each of the elongated female conductors 37 has branched female ends or contacts 37*a* for receiving the sharpened end 32*a* of the male conductors 32 and branched lead ends or contact 37*b* for connection to another printed wiring board (not shown). Each of the female signal terminals 38 has a female end or contact 38*a* for receiving the sharpened end 33*a* of the male signal terminal 33 and, at the other end, a contact 37*b* for connection to another printed wiring board. The ends 38*b* of the female signal terminals 38 are bent in a staggered array. The female conductors 37 are made from a combination of elastic flat plates of good electric conductivity and the female signal terminals 38 are made from small rods of good electric conductivity.

The jack housing 36 has a pair of ridges 36*c* at opposite corners of the jack housing 36. The ridges 36*c* mate with the guide walls 34*d* of the ground shell 34 for assisting a mating engagement of the male conductors 32 with the corresponding female conductors 37 in the jack connector member 35 and for preventing an inaccurate insertion.

The ground shell 34 extends beyond the end of the plug housing 31 to the jack housing 36 with one end of the jack housing 36 abutting the second end of the plug housing 31, as shown in FIG. 4. Preferably, the ground shell 34 covers at least partly the outer peripheral surface 36*a* of the jack housing 36 so that a portion of the ground shell 34 overlaps the female conductors 37. Preferably, the ground shell 34 extends between the outer peripheral shoulder 31*b* of the plug housing 31 and the outer peripheral shoulder 36*b* of the jack housing 36. Accordingly, the ground shell 34 also acts with the elongated female conductors 37 in the jack housing 36 to constitute a strip line structure for the female signal terminals 38.

Figure 6:
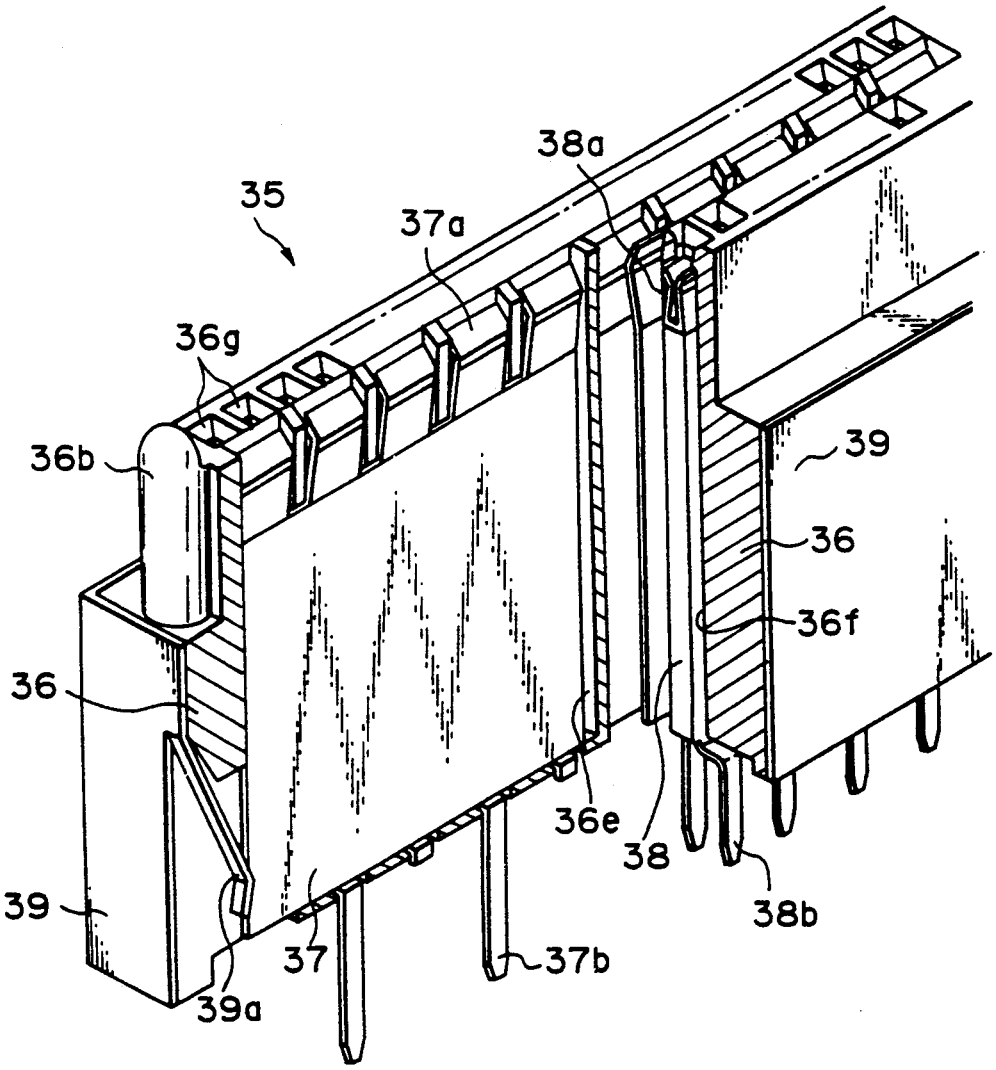
FIG. 6 is a view of a jack connector member according to the second embodiment of the present invention.

FIG. 6 is a view of a jack connector member 35 according to the second embodiment of the present invention. This jack connector member 35 has a similar arrangement to that of the jack connector member 35 of FIG. 3, except that the jack connector member 35 of FIG. 6 is taller than that of the latter and the ground shell 34 cannot fully cover the elognated female conductors 37 in the jack housing 36. In this case, an additional conductive ground shell 39 is attached to the jack housing 36. Preferably, the first ground shell 34 is arranged to extend the plug housing 31 and to abut the outer peripheral shoulder 36*b* of the jack housing 36, and the second ground shell is arranged on the outer peripheral shoulder 36*b* of the jack housing 36, so that the first and the second ground shells 34 and 39 are substantially continuous. The second ground shell 39 has a tongue 39*a* at the small side of the ground shell 39 which provides for an electrical connection to the elongated female conductor 37.

The following table is a result of a test of impedance and crosstalk on three electrical connectors A to C. The connector A is the connector 10 of the first embodiment, and the connectors B and C are connectors having identical shapes to the connector 10, and the connector B has the ground shell 34 attached to the plug housing 31 but is not connected to the ground. The connector C does not have the ground shell 34 attached to the plug housing 31 and has a microstrip line structure.

| load | 50 Ω | | |
|---|---|---|---|
| connector | C | B | A |
| impedance (Ω) | 58.3 | 49.3 | 49.2 |
| crosstalk (mV) | | | |
| (near-end) | 350 | 235 | 230 |
| (far-end) | 80 | 10 | 5 |

The near-end crosstalk is a value measured at the pulse input side (the jack side) and the far-end crosstalk is a value measured at the plug side. As will be apparent, the connector A realizes only a small amount of crosstalk, compared to the other connectors. The connector B showed a similar impedance to that of the connector A. The reason is not apparent but may be derived from the fact that a small number of the signal terminals are activated in the test and the ground shell 34 is large in size so that the ground shell 34 is at a stable potential during the test, as if it were connected to the ground. It will be apparent that the ground shell 34 should be preferably connected to the ground in actual use. Also, it is preferable that the rows of signal terminals 33 and 38 are located at the center (i.e., in a central plane) between the elongated conductors 32 and 37 and the planar shell portions 34*a* and 34*b* of the ground shell 34 for most effectively reducing the amount of crosstalk.

Figure 7:
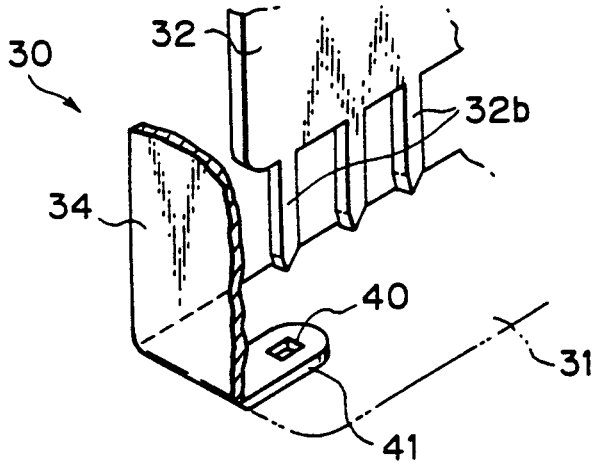
FIG. 7 is a view of a plug connector member according to the third embodiment of the present invention.
Figure 8A:
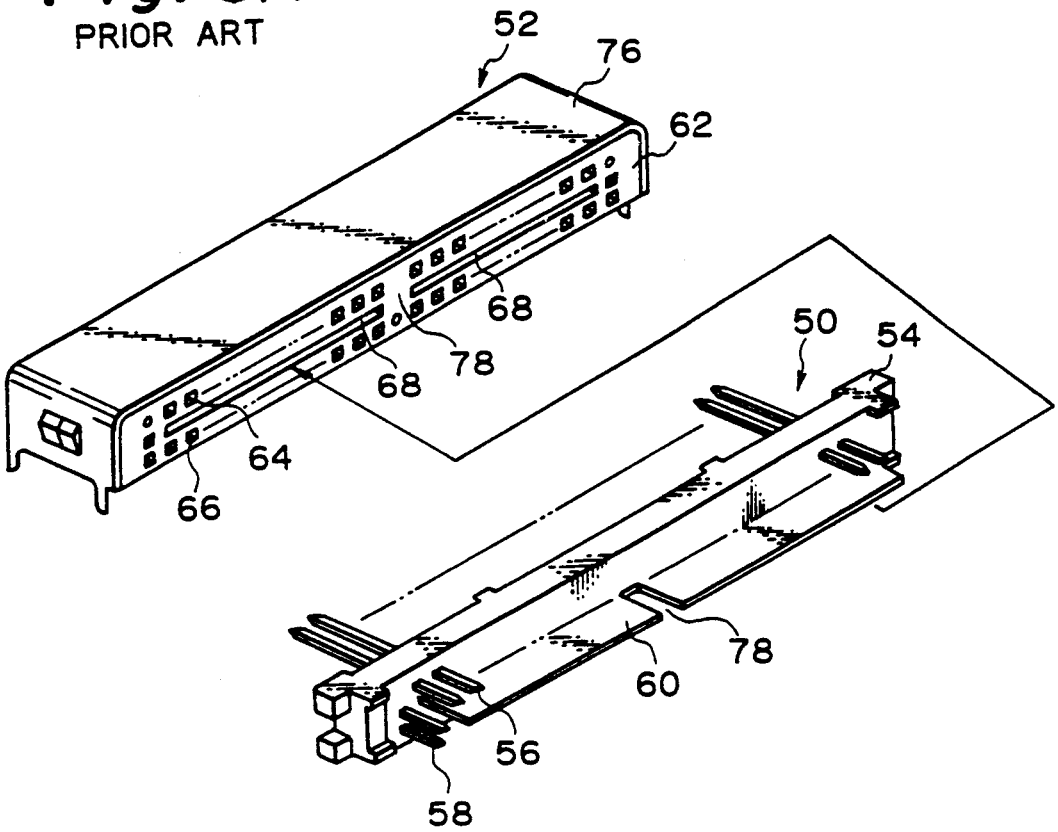
Fig. 8A PRIOR ART
FIGS. 8A to 8C are views of a prior art connector.
Figure 8B:
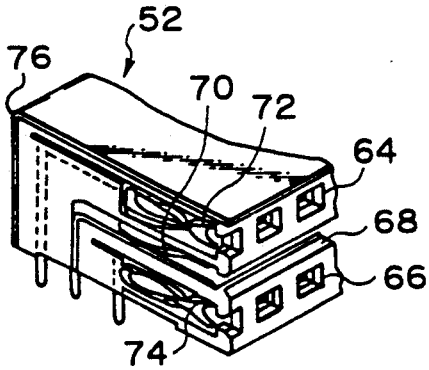
Fig. 8B PRIOR ART
Figure 8C:
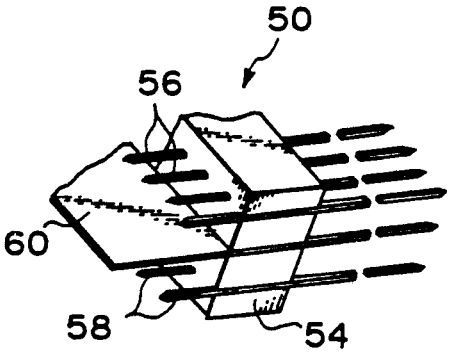
Fig. 8C PRIOR ART

The electrical connector 10 has 100 signal terminals 33 arranged in the plug housing 31 having the size of, for example, 64 mm in length along the long side thereof and 4 mm in length along the short (i.e., small) side thereof. The height of the electrical connector 10 is approximately 20 mm. The electrical connector 10 is adapted for high speed signal processing in the level of, for example, approximately 1 GHz. Therefore, it is preferable to select the insulating material of the plug housing 31 and the jack housing 36 having a low dielectric constant adapted for such a high frequency level to effectively reduce the amount of the crosstalk. It has been found that a liquid crystal polymer is adapted for the insulating material of the plug housing 31 and the jack housing 36. In addition, the liquid crystal polymer has a sufficient strength to allow the plug housing 31 and the jack housing 36 to have a thin walled structure as described above and a temperature resistive property sufficient to endure heat during a soldering process. The liquid crystal polymer has a good flowability in a molding process. FIG. 7 is a view of a plug connector member 30 according to the third embodiment of the present invention. The plug connector member 30 comprises a plug housing 31, the elongated male conductors 32, the ground shell 34, and other elements such as signal terminals, similar to the plug connector member 30 of FIG. 2. The tongue 34*c* of FIG. 2 is replaced by tongue 41 in FIG. 7. The tongue 41 extends from one end of the ground shell 34 and is bent along the end surface of the plug housing 31 from which the branched ends 32*b* of the elongated male conductor 32 project. The tongue 41 has a hole 40 through which one of the branched ends 32*b* of the elongated male conductor 32 is passed for establishing an electric connection between the ground shell 34 and the elongated male conductor 32 and a mechanical connection of the ground shell 34 to the plug housing 31. If the outer peripheral shoulder 31*b* is provided adjacent to the end of the plug housing 31 it is possible to provide a slit at the outer peripheral shoulder 31*b* for passage of the tongue 41. Also, the tongue 39*a* of FIG. 6 can be replaced by a tongue similar to 41 in FIG. 7.

As explained in detail, it is possible to obtain an electical connector having a desired impedance characteristic in a strip line structure for matching an impedance characteristic of printed wiring boards, and to realize an electrical connector having a stable impedance characteristic which is less affected by external noise and wherein the amount of crosstalk is relatively low based on the strip line structure.

We claim:

1. An impedance matched electrical connector comprising a plug connector member and a jack connector member matable with the plug connector member and affording an electrical connection between printed wiring boards, said plug connector member comprising:

a plug housing of insulating material having an axis, an outer peripheral surface about the axis, at least one elongated slotted opening arranged in a first plane parallel to the axis, a first row of small holes arranged in a second plane parallel to the first plane, and a second row of small holes arranged in a third plane parallel to the first plane and disposed on the side of the at least one elongated slotted opening remote from the first row of small holes; the outer peripheral surface including first and second opposite planar outer surface portions arranged in parallel relationship to the first plane in an overlapping, opposed relationship with respect to the at least one elongated slotted opening and the first and second rows of small holes;

at least one generally planar and elongated male conductor fitted in the at least one elongated slotted opening;

a first row of male signal terminals fitted in said first row of small holes, respectively;

a second row of male signal terminals fitted in said second row of small holes, respectively; and a conductive ground shell attached to the outer peripheral surface of the plug housing, the ground shell having a first planar shell portion covering the first planar outer surface portion, such that the distance between the first planar shell portion and the first row of male signal terminals substantially equals the distance between the first row of male signal terminals and the elongated male conductor, and a second planar shell portion covering the second planar outer surface portion, such that the distance between the second planar shell portion and the second row of male signal terminals substantially equals the distance between the second row of male signal terminals and the elongated male conductor, whereby the impedance of the first and second rows of male signal terminals is controlled by the at least one elongated male conductor and the ground shell; and the jack connector member comprising a jack housing of insulating material, at least one female conductor disposed for mating engagement with the elongated male conductor, a first row of female signal terminals disposed for mating engagement with the first row of male signal terminals, and a second row of female signal terminals disposed for mating engagement with the second row of male signal terminals.

2. A connector according to claim 1, wherein the at least one female conductor of the jack connector member is generally planar and elongated.

3. A connector according to claim 2, wherein the at least one elongated male conductor comprises at least one male ground conductor and at least one male power supply conductor arranged in the first plane in a row, and the at least one female conductor comprises correspondingly at least one female ground conductor and at least one female power supply conductor arranged in a plane in a row.

4. A connector according to claim 1, wherein the ground shell is connected to the at least one elongated male conductor for electrical connection therebetween.

5. A connector according to claim 4, wherein the ground shell is connected to the at least one elongated male conductor for electrical connection therebetween and for mechanical connection of the ground shell to the plug housing.

6. A connector according to claim 1, wherein the ground shell is formed in a continuously closed shape, encircling the outer peripheral surface of the plug housing.

7. A connector according to claim 1, wherein the plug housing has a first end directed to a printed wiring board, a second end directed to the jack connector member, and an outer peripheral shoulder adjacent to the first end, the ground shell being arranged on the outer peripheral surface of the plug housing in an abutment relationship with the outer peripheral shoulder.

8. A connector according to claim 7, wherein the ground shell has a length such that the ground shell abuts at one end thereof the outer peripheral shoulder of the plug housing and extends beyond the second end of the plug housing to the jack housing.

9. A connector according to claim 8, wherein the jack housing has an outer peripheral surface, a first end directed to the plug housing, a second end directed to another printed wiring board, and an outer peripheral shoulder adjacent the second end of the jack housing, the ground shell extending beyond the second end of the plug housing to the jack housing with the first end of the jack housing abutting the second end of the plug housing.

10. A connector according to claim 9, wherein the ground shell covers at least partly the outer peripheral surface of the jack housing so that a portion of the ground shell overlaps the at least one female conductor.

11. A connector according to claim 9, wherein the ground shell extends between the outer peripheral shoulder of the plug housing and the outer peripheral shoulder of the jack housing.

12. A connector according to claim 8, wherein the at least one elongated conductor of the plug connector member extends beyond the second end of the plug housing.

13. A connector according to claim 8, wherein the ground shell has a guide means and the jack housing has an associated guide means for assisting the mating engagement of the at least one male conductor with the at least one female conductor.

14. A connector according to claim 1, wherein the ground shell has a guide means and the jack housing has an associated guide means for assisting the mating engagement of the at least one male conductor with the at least one female conductor.

* * * * *